US006785502B2

(12) United States Patent
Kondoh

(10) Patent No.: US 6,785,502 B2
(45) Date of Patent: Aug. 31, 2004

(54) IMAGE FORMING APPARATUS AND METHOD OF PREVENTING TONER FROM TRANSFERRING FROM IMAGE CARRIER TO REVERSE SURFACE OF SHEET

(75) Inventor: Kazuyoshi Kondoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/216,302

(22) Filed: Aug. 12, 2002

(65) Prior Publication Data

US 2003/0031483 A1 Feb. 13, 2003

(30) Foreign Application Priority Data

Aug. 13, 2001 (JP) ..... 2001-245675

(51) Int. Cl.[7] ..... G03G 15/16
(52) U.S. Cl. ..... 399/313; 399/66
(58) Field of Search ..... 399/98, 99, 66, 399/167, 297, 302, 308, 310, 312, 313, 317

(56) References Cited

U.S. PATENT DOCUMENTS 4,515,460 A * 5/1985 Knechtel ..... 399/302
4,931,839 A * 6/1990 Tompkins et al. ..... 399/66
5,291,252 A * 3/1994 Kawaishi ..... 399/308 X
5,966,561 A * 10/1999 Yamaguchi ..... 399/66
5,995,795 A * 11/1999 Berlin ..... 399/313
6,167,215 A * 12/2000 Miyashiro et al. ..... 399/66
6,269,228 B1 * 7/2001 Kayahara et al. ..... 399/302 X

FOREIGN PATENT DOCUMENTS

| | | |
|---|---|---|
| JP | 7-53091 | 12/1995 |
| JP | 2000-47475 | 2/2000 |
| JP | 2000-330327 | 11/2000 |

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming apparatus of the present invention includes an image transferring device for transferring a toner image from an image carrier to a recording medium and a moving device for selectively moving the image transferring device toward or away from the image carrier. The moving device moves the image transferring device toward the image carrier on the elapse of at least a period of time necessary for the image carrier to rotate from a rotation start position to a reversely rotated position. Assume that a distance between a position where the image transferring device approaches the image carrier and a position where the toner image starts being formed on the image carrier is a, that the image carrier is reversely rotated by a distance of b, that the linear velocity of the image carrier is V, and that a period of time between the start of rotation of the image carrier and image formation is c, then a period of time t necessary for the image transferring device approaches the image carrier after the start of rotation of the image carrier is satisfies a relation of (a+b)/V<t<c.

23 Claims, 6 Drawing Sheets

IMAGE FORMING APPARATUS AND METHOD OF PREVENTING TONER FROM TRANSFERRING FROM IMAGE CARRIER TO REVERSE SURFACE OF SHEET

BACKGROUND OF THE INVENTION

1. Field of the Invention

The present invention relates to a copier, printer, facsimile apparatus, multifunction apparatus or similar image forming apparatus configured to form a toner image on an image carrier with toner grains having a small size and then transfer the toner image to a sheet or recording medium.

2. Description of the Background Art

It is a common practice with an image forming apparatus to form a latent image on a photoconductive element or image carrier, which may be implemented as a drum or a belt, develop the latent image to thereby produce a corresponding toner image, and transfer the toner image to a sheet by use of image transferring means, which may also be implemented as a belt or a roller. A color copier, for example, includes four developing units each storing one of black toner, cyan toner, magenta toner and yellow toner. The developing devices respectively form a black, a cyan, a magenta and a yellow toner image on associated photoconductive drums. Such toner images of different colors are sequentially transferred to a sheet one above the other by image transferring means, which may be implemented as a belt or a roller, completing a full-color image on the sheet. Subsequently, a fixing unit fixes the full-color image on the sheet.

In the image forming apparatus, when an image transfer clutch is coupled in accordance with the rotation of a main motor, the clutch causes a cam to rotate. Consequently, before toner deposited on the drum in a developing zone passes a nip for image transfer, the belt or the roller for image transfer contacts the drum, so that the toner deposits on the belt or the drum. The toner deposited on the belt or the drum is transferred to the reverse side of a sheet (so-called offset) due to defective cleaning.

A current trend in the image forming apparatus art is toward the use of toner grains and carrier grains having a small size each. Toner grains with a small size enhance the resolution of an image and the reproducibility of thin lines. Also, carrier grains with a small size obtain a greater surface area relative to the carrier grains and thereby allow a toner content to be increased for improving developing efficiency. However, such toner grains and carrier grains bring about the following problems.

When the drum is in a halt or is rotating, the high toner content increases the amount of toner to be transferred from a developing sleeve to the non-image portion of the drum. If an image is formed in such a condition, then the toner is transferred from the drum to the belt or the roller for image transfer at the nip when the belt or the roller is brought into contact with the drum. Although a cleaning blade or cleaning means cleans the surface of the belt or the roller before a sheet arrives at the nip, the former is apt to fail to fully clean the latter when the toner with a small size is left on the belt or the roller in a great amount.

Further, because the timing for causing the belt to contact the drum is based on the rotation of the main motor, the belt contacts the drum before the toner deposited on the drum during the halt or the rotation of the drum passes the nip. As a result, the toner is transferred from the drum to the belt and again brings about offset ascribable to defective cleaning.

Japanese Patent Laid-Open Publication No. 8-297420, for example, discloses a system in which a potential of the same polarity as the toner is applied to the belt in order to promote efficient cleaning. This system, however, has a problem that the belt must make at least one turn before a sheet arrives at the nip in order to electrostatically return the toner deposited on the belt at the nip to the drum, extending a period of time up to the start of image transfer. Another problem is that the toner deposited on the belt cannot be entirely returned to the drum like the toner cannot be transferred from the drum to a sheet with 100% efficiency. Moreover, nip pressure causes part of the toner to be transferred from the drum to the belt in addition to the electrostatic force.

Japanese Patent Laid-Open Publication No. 11-38776, for example, proposes a cleaning device assigned to the belt and including second cleaning means in addition to the cleaning blade or similar cleaning means. The second cleaning means is implemented as a roller or a brush to which a voltage of the same polarity as the toner is applied. The second cleaning means, however, increases the cost of the cleaning means and makes the entire apparatus bulky and sophisticated.

Technologies relating to the present invention are also disclosed in, e.g., Japanese Utility Model Publication No. 7-53091 and Japanese Patent Laid-Open Publication Nos. 9-90778, 2000-47475 and 2000-330327.

SUMMARY OF THE INVENTION

It is an object of the present invention to provide an image forming apparatus capable of preventing toner from being transferred from an image carrier to the reverse surface of a sheet by way of image transferring means to thereby insure high image quality.

It is another object of the present invention to provide a small size, simple, low cost image forming apparatus.

An image forming apparatus of the present invention includes a rotatable image carrier for forming a toner image thereon, an image transferring device for transferring the toner image to a recording medium, and a moving device for selectively moving the image transferring device toward or away from the image carrier. The moving device moves the image transferring device toward the image carrier on the elapse of at least a period of time necessary for the image carrier to rotate from a rotation start position to a reversely rotated position. Assume that a distance between a position where the image transferring device approaches the image carrier and a position where the toner image starts being formed on the image carrier is a, that the image carrier is reversely rotated by a distance of b, that the linear velocity of the image carrier is V, and that a period of time between the start of rotation of the image carrier and image formation is c, then a period of time t necessary for the image transferring device approaches the image carrier after the start of rotation of the image carrier satisfies a relation of $(a+b)/V<t<c$.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
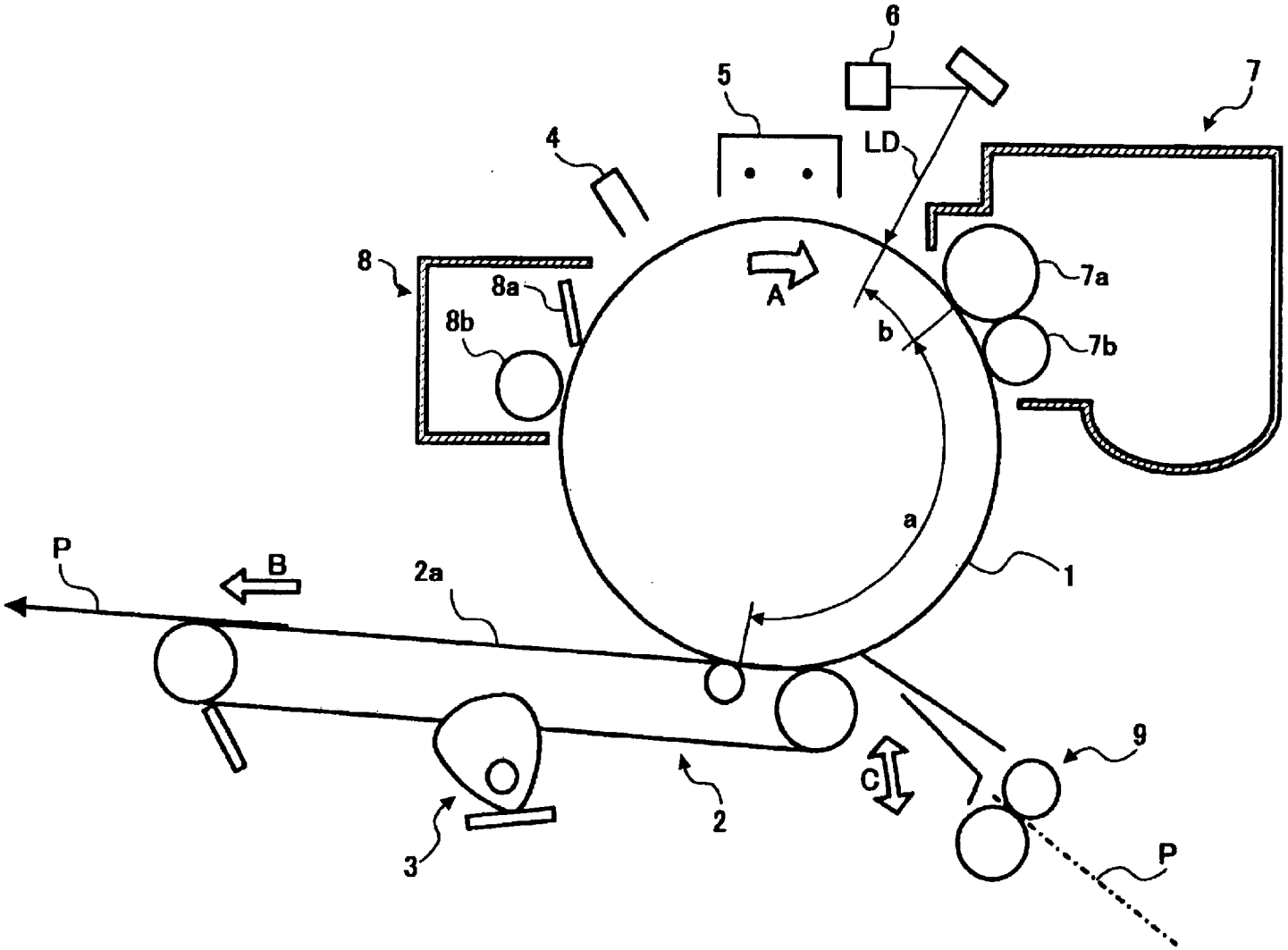
FIGS. 1 through 3 are views showing the construction and operation of an image forming apparatus embodying the present invention.

Referring to FIG. 1 of the drawings, an image forming apparatus embodying the present invention is shown. As shown, the image forming apparatus includes a photoconductive drum or image carrier 1 rotatable in a direction indicated by an arrow A. A toner image is formed on the drum 1 by use of a developer made up of carrier grains and toner grains having a small size each. Image transferring means 2 for transferring the toner image to a sheet or recording medium P includes an endless belt 2*a* movable in a direction indicated by an arrow B. The belt 2*a* my be replaced with an image transfer roller, not shown, if desired. Moving means 3 selectively moves the belt 2*a* toward or away from the drum 1 in a direction indicated by an arrow C. The moving means 3 moves the belt 2*a* toward the drum 1 at least after the drum 1 has rotated by a distance of (a+b), which will be described specifically later. This prevents the toner from being transferred from the drum 1 to the belt 3 and therefore to the reverse surface of the sheet P.

Also arranged around the drum 1 are discharging means 4, charging means 5, latent image forming means 6, developing means 7 including an upper sleeve 7*a* and a lower sleeve 7*b*, and cleaning means 8 including a cleaning blade 8*a* and a cleaning brush 8*b*. The charging means 5 uniformly charges the surface of the drum 1. After the transfer of the toner image from the drum 1 to the sheet P, the cleaning blade 8*a* and cleaning brush 8*b* remove the toner left on the drum 1. Subsequently, the discharging means 4 discharges the cleaned surface of the drum 1 to thereby prepare it for the next image forming cycle. Thereafter, the drum 1 is caused to stop rotating for a moment.

While the drum 1 plays the role of an image carrier in the illustrative embodiment, the image carrier may alternatively be implemented as a photoconductive belt, an intermediate image transfer belt or an intermediate image transfer roller.

Figure 2:
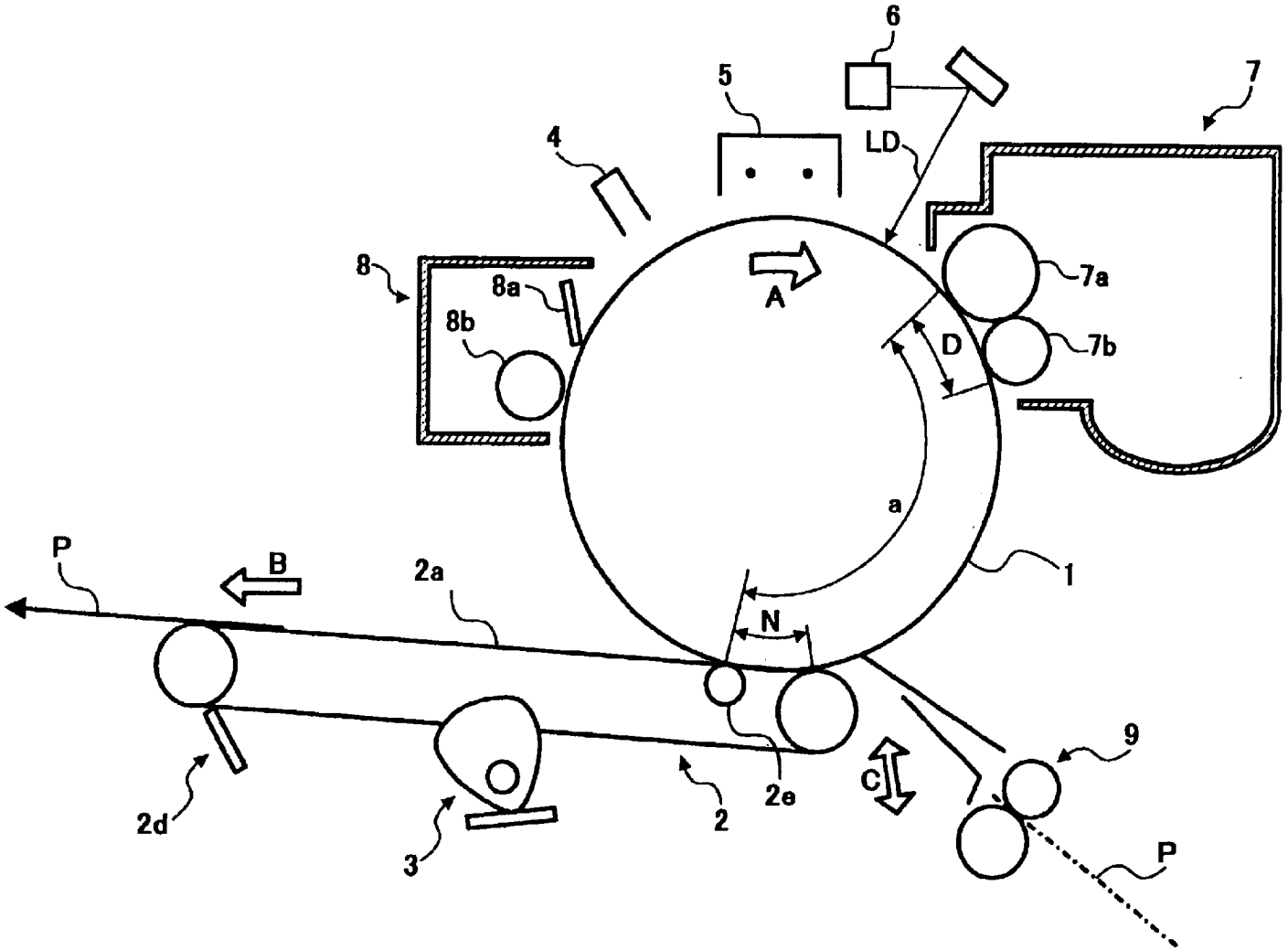
Figure 3:
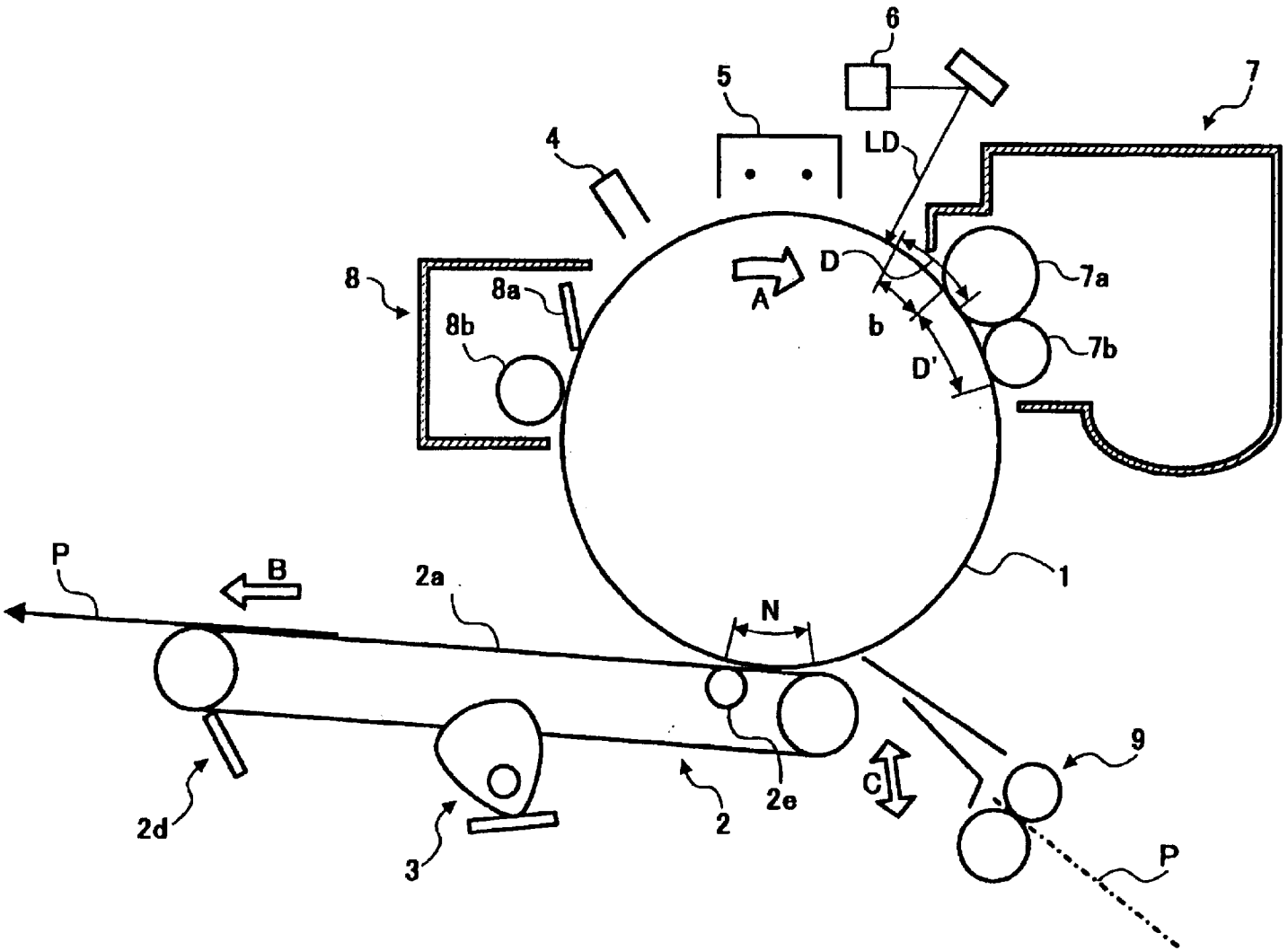

As shown in FIGS. 2 and 3, after the drum 1 has stopped rotating for a moment, the toner grains as well as impurities are transferred to the non-image portion of the drum 1 over a developing zone D facing the sleeves 7*a* and 7*b*. At this instant, a distance between a nip N for image transfer and the developing zone D is a, as measured on the drum 1. After the momentary stop of the drum 1, the drum 1 is caused to rotate in the reverse direction by a distance b, so that impurities caught by the cleaning blade 8*a* are released from the blade 8*a*. After the reverse rotation of the drum 1, a main motor, not shown, is fully deenergized to end a single image forming job. Likewise, after the start of the next image forming job, the toner grains are transferred to the non-image portion of the drum 1 over a developing zone D' facing the sleeves 7*a* and 7*b*.

The charging means 5 uniformly charges the surface of the drum 1 to negative polarity. The latent image forming means 6 scans the charged surface of the drum 1 with a laser beam in accordance with image data to thereby form a latent image on the drum 1.

In the developing means 7, the developer is deposited on the sleeves 7*a* and 7*b*. The toner grains, which are contained in the developer and assumed to be black toner grains, are transferred from the sleeves 7*a* and 7*b* to the latent image carried on the drum 1, forming a corresponding toner image.

The sheet P is fed from sheet feeding means, not shown, to a registration roller pair 9. The registration roller pair 9 once stops the sheet P and then conveys it toward the belt 2*a* at such a timing that the leading edge of the sheet P meets the leading edge of the toner image.

The image transferring means 2 includes a belt cleaner 2*d* and a bias roller 2*e* in addition to the belt 2*a*. After an image forming job, the moving means 3 moves the belt 2*a* away from the drum 1 just before the main motor stops rotating.

Figure 4:
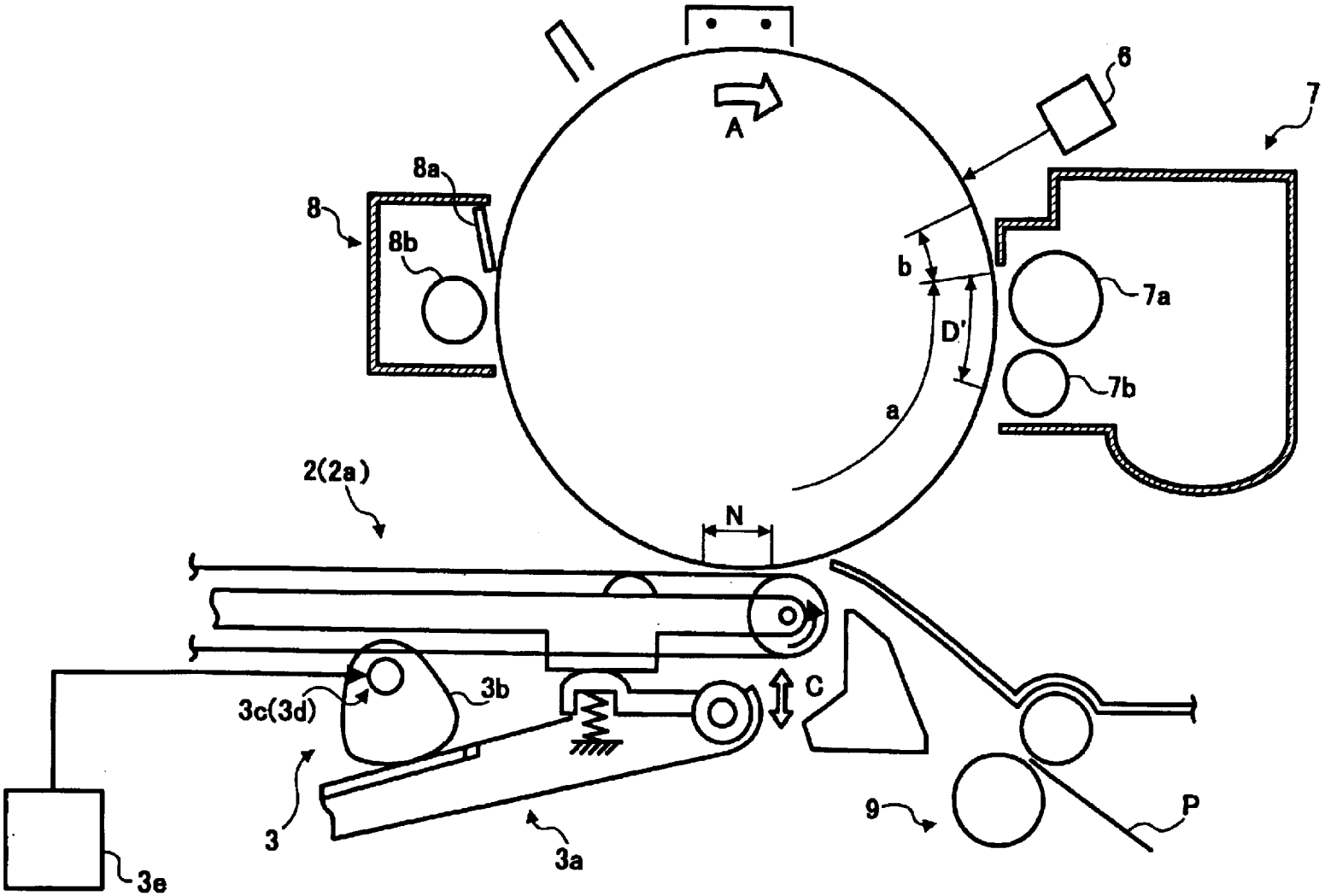
FIGS. 4 and 5 are views showing an alternative embodiment of the present invention.
Figure 5:
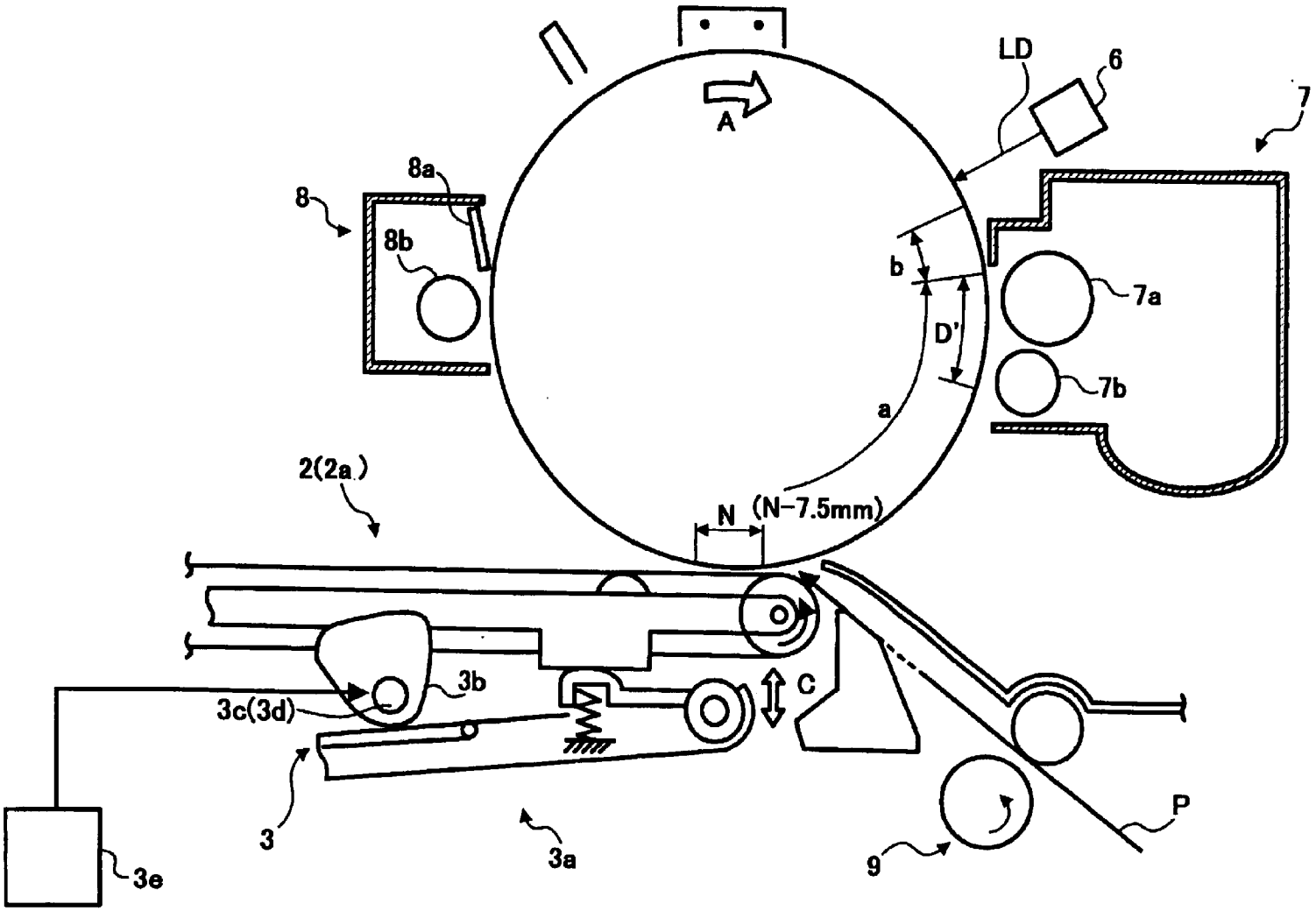
Figure 6:
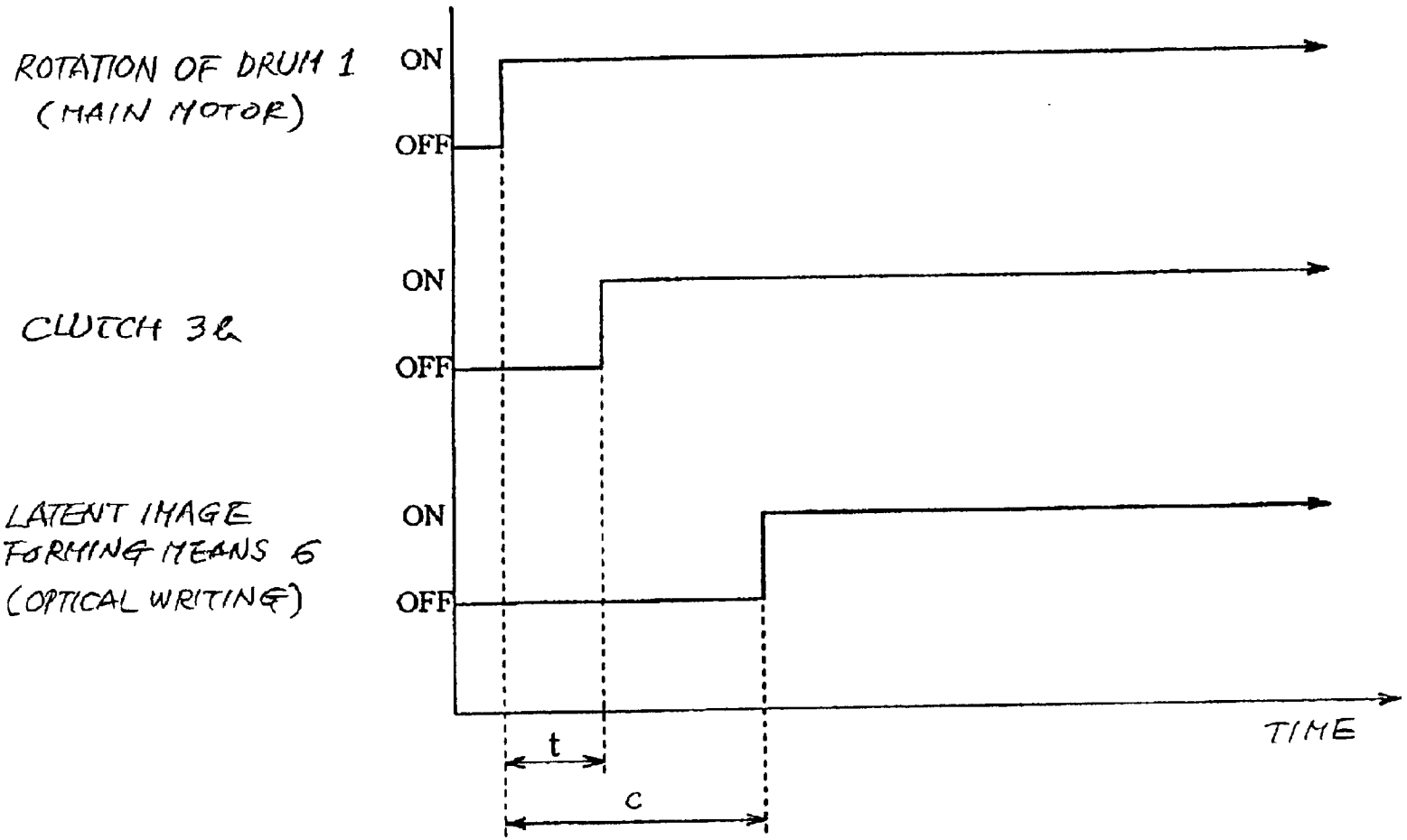
FIG. 6 is a timing chart demonstrating the operation of the embodiment shown in FIGS. 4 and 5.

Reference will be made to FIGS. 4, 5 and 6 for describing an alternative embodiment of the present invention. As shown, the illustrative embodiment includes moving means 3 generally made up of a lever 3*a*, a cam 3*b*, a half-rotation clutch 3*d* mounted on a shaft 3*c*, and a controller 3*e*. The output torque of the main motor is transferred to the shaft 3*c* via a gear train not shown. When the half-rotation clutch 3*d* is coupled, the lever 3*a* is raised or lowered by the cam 3*b* in accordance with the profile of the cam 3*b*. The controller 3*e* controls the cam 3*b* such that the belt 2*a* moves toward or away from the drum 1 on the elapse of a period of time necessary for the drum 1 to rotate from a position where rotation begins, as seen on the drum 1, to a reversely rotated position, but at a position between the rotation start position and a position where a toner image starts being formed.

When the belt 2*a* is brought into contact with the drum 1, it forms the nip N of 7.5 mm More specifically, after the toner on the drum 1 has moved away from the nip N, the belt 2*a* is brought into contact with the drum 1. This can be done with the following configuration. Assume that the distance a between the nip N and the developing zone D, as measured on the drum 1 is 230 mm, that the distance b by which the drum 1 is reversely rotated is 10 mm, and that the linear velocity V of the drum 1 is 200 mm/sec. Then, as shown in FIG. 6, the clutch 3*d* is coupled after a period of time of (a+b)/V (=0.7 sec), has elapsed since the start of rotation of the drum 1.

Further, the controller 3*e* insures stable image quality despite vibration that may occur when the belt 2*a* approaches or contacts the drum 1 via the sheet P. For this purpose, the controller 3*e* couples the clutch 3*d* within a period of time c of 2.3 seconds (see FIG. 6) between the time when the main motor and therefore the drum 1 starts rotating before the latent image forming means 6 starts scanning the drum 1 and the time when the latent image forming means 6 starts scanning the drum 1.

By selecting a relation of $(a+b)/V<t<c$, it is possible to stably write a latent image on the drum 1 without regard to the vibration stated above. In addition, when the drum 1 is in a halt or is rotating, the toner transferred from the sleeves 7*a* and 7*b* to the drum 1 is prevented from being transferred to the belt 2*a*. This surely obviates the transfer of the toner to the reverse surface of the first sheet P without regard to the cleaning ability. It follows that high image quality is achievable with a small size, simple and low-cost configuration.

In summary, it will be seen that the present invention provides a small size, simple, low cost image forming apparatus capable of obviating the transfer of toner to image transferring means and therefore the offset of a recording medium. Further, high image quality is achievable without regard to vibration ascribable to a shock that may occur when the image transferring means approaches an image carrier.

Various modifications will become possible for those skilled in the art after receiving the teachings of the present disclosure without departing from the scope thereof.

What is claimed is:

1. An image forming apparatus comprising:

a rotatable image carrier for forming a toner image thereon;

image transferring means for transferring the toner image to a recording medium; and moving means for selectively moving said image transferring means toward or away from said image carrier; wherein said moving means moves said image transferring means toward said image carrier on the elapse of at least a period of time necessary for said image carrier to rotate from a rotation start position to a reversely rotated position, and a distance between a position where said image transferring means approaches said image carrier and a position where the toner image starts being formed on said image carrier is a, said image carrier is reversely rotated by a distance of b, a linear velocity of said image carrier is V, and a period of time between a start of rotation of said image carrier and image formation is c, then a period of time t necessary for said image transferring means to approach said image carrier after the start of rotation of said image carrier satisfies a relation:

$$(a+b)/V<t<c.$$

2. The apparatus as claimed in claim 1, wherein the toner image is formed on said image carrier using toner grains having a small grain size.

3. The apparatus as claimed in claim 2, wherein the toner is mixed with carrier grains having a small grain size.

4. The apparatus as claimed in claim 3, wherein said image carrier comprises a photoconductive element.

5. The apparatus as claimed in claim 4, wherein said photoconductive element comprises a drum.

6. The apparatus as claimed in claim 2, wherein said image transferring means comprises an image transfer belt.

7. The apparatus as claimed in claim 2, wherein said moving means moves said image transferring means toward said image carrier at a position preceding at least a position, as seen on said image carrier, between a position where said image carrier starts rotating and a position where the toner image is formed on said image carrier.

8. The apparatus as claimed in claim 1, wherein the toner is mixed with carrier grains having a small grain size.

9. The apparatus as claimed in claim 8, wherein said image carrier comprises a photoconductive element.

10. The apparatus as claimed in claim 9, wherein said photoconductive element comprises a drum.

11. The apparatus as claimed in claim 8, wherein said image transferring means comprises an image transfer belt.

12. The apparatus as claimed in claim 8, wherein said moving means moves said image transferring means toward said image carrier at a position preceding at least a position, as seen on said image carrier, between a position where said image carrier starts rotating and a position where the toner image is formed on said image carrier.

13. The apparatus as claimed in claim 1, wherein said image carrier comprises a photoconductive element.

14. The apparatus as claimed in claim 13, wherein said photoconductive element comprises a drum.

15. The apparatus as claimed in claim 1, wherein said image transferring means comprises an image transfer belt.

16. The apparatus as claimed in claim 1, wherein said moving means moves said image transferring means toward said image carrier at a position preceding at least a position, as seen on said image carrier, between a position where said image carrier starts rotating and a position where the toner image is formed on said image carrier.

17. An image forming apparatus comprising:

a rotatable image carrier for forming a toner image thereon;

an image transferring device configured to transfer the toner image to a recording medium; and a moving device configured to selectively move said image transferring device toward or away from said rotatable image carrier; wherein said moving device moves said image transferring device toward said rotatable image carrier on the elapse of at least a period of time necessary for said rotatable image carrier to rotate from a rotation start position to a reversely rotated position, and a distance between a position where said image transferring device approaches said rotatable image carrier and a position where the toner image starts being formed on said rotatable image carrier is a, said rotatable image carrier is reversely rotated by a distance of b, a linear velocity of said rotatable image carrier is V, a period of time between a start of rotation of said rotatable image carrier and image formation is c, then a period of time t necessary for said image transferring device to approach said rotatable image carrier after the start of rotation of said rotatable image carrier satisfies a relation:

$$(a+b)/V<t<c.$$

18. The apparatus as claimed in claim 17, wherein the toner image is formed on said rotatable image carrier using toner grains having a small grain size.

19. The apparatus as claimed in claim 18, wherein the toner is mixed with carrier grains having a small grain size.

20. The apparatus as claimed in claim 19, wherein said rotatable image carrier comprises a photoconductive element.

21. The apparatus as claimed in claim 20, wherein said photoconductive element comprises a drum.

22. The apparatus as claimed in claim 18, wherein said image transferring device comprises an image transfer belt.

23. The apparatus as claimed in claim 18, wherein said moving device moves said image transferring device toward said rotatable image carrier at a position preceding at least a position, as seen on said rotatable image carrier, between a position where said rotatable image carrier starts rotating and a position where the toner image is formed on said rotatable image carrier.

* * * * *